US006589107B2

(12) United States Patent
Lee

(10) Patent No.: US 6,589,107 B2
(45) Date of Patent: Jul. 8, 2003

(54) BATH BALL STRUCTURE

(75) Inventor: Giovanni Lee, Changhua Hsien (TW)

(73) Assignee: Chien-Chang Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 09/836,186

(22) Filed: Apr. 18, 2001

(65) Prior Publication Data

US 2002/0155800 A1 Oct. 24, 2002

(51) Int. Cl.[7] ..... B24D 11/00

(52) U.S. Cl. ..... 451/527; 451/526; 451/532; 15/209.1; 15/229.11; 15/229.12; 15/229.13; 15/229.14

(58) Field of Search ..... 451/526, 527, 451/532; 15/209.1, 229.11, 229.12, 229.13, 229.14, 209.9

(56) References Cited

U.S. PATENT DOCUMENTS 4,829,622 A * 5/1989 O'Sullivan ..... 15/209
5,970,566 A * 10/1999 Girardot et al. ..... 15/229
6,092,257 A * 7/2000 Chen ..... 15/209.1

* cited by examiner

*Primary Examiner*—Joseph J. Hail, III
*Assistant Examiner*—Shantese McDonald
(74) *Attorney, Agent, or Firm*—Troxell Law Office PLLC

(57) ABSTRACT

Bath ball structure including a bathing body and a string tying the bathing body. The bathing body is composed of multiple brushing layers overlapping one another and thermally fused with one another at the center thereof. One face of each brushing layer is formed with a number of through holes. The other face of the brushing layer is formed with a number of corresponding abrasive projections with good frictional force. The bathing body is repeatedly folded back and forth to form a semiproduct of the bath ball having multiple crimps. The string is tied at the thermal fusion seam of the center of the semiproduct to form a bath ball product. When used or sold, the respective brushing layers of the bath ball product are pulled outward to form the bath ball.

1 Claim, 3 Drawing Sheets

BATH BALL STRUCTURE

BACKGROUND OF THE INVENTION

The present invention is related to a bath ball structure which is very soft so that when a user brushes his/her body with the bath ball, the user will not feel painful and the skin of the user is not subject to scrape. Prior to being outward pulled, the bath ball has small volume so that it can be easily transferred and stored. When outward pulled, the bath ball has a beautiful appearance for expediting purchase desire of consumers.

FIG. 1 shows a conventional bath ball 10 composed of several layers of meshes 11 wrapping each other. The bath ball 10 is tied by a string 20 to facilitate taking the bath ball 10 when used and hanging the bath ball 10 when not used.

The above bath ball has some shortcomings as follows:

1. The meshes 11 are quite rough so that when a user brushes his/her body with the bath ball 10 made of the meshes 11, the user often feels uncomfortable or painful and the skin of the user is subject to scrape.
2. The bath ball 10 has considerably large volume so that it will occupy much room when transferred or stored.
3. The bath ball 10 has monotonous pattern so that it is not attractive to consumers and the purchase desire of the consumers can be hardly expedited.

SUMMARY OF THE INVENTION

It is therefore a primary object of the present invention to provide a bath ball structure in which the brushing layers are made of plastic membrane which are very soft so that when a user brushes his/her body with the bath ball, the user will not feel uncomfortable or painful and the skin of the user is not subject to scrape.

It is a further object of the present invention to provide the above bath ball structure in which a number of abrasive projections are formed over the bath ball so that the bath ball is soft, while providing sufficient frictional force against the skin of the user so that the body of the user can be truly cleaned.

It is still a further object of the present invention to provide the above bath ball structure in which prior to being outward pulled, the bath ball product has small volume so that when transferred or stored, it will not occupy much room so that the transferring and storage are facilitated.

It is still a further object of the present invention to provide the above bath ball structure in which the brushing layers of the bath ball can be outward pulled to has a beautiful appearance so that the purchase desire of consumers can be expedited.

The present invention can be best understood through the following description and accompanying drawings wherein:

DETAILED DESCRIPTION OF THE PREFERRED EMBODIMENT

Figure 1:
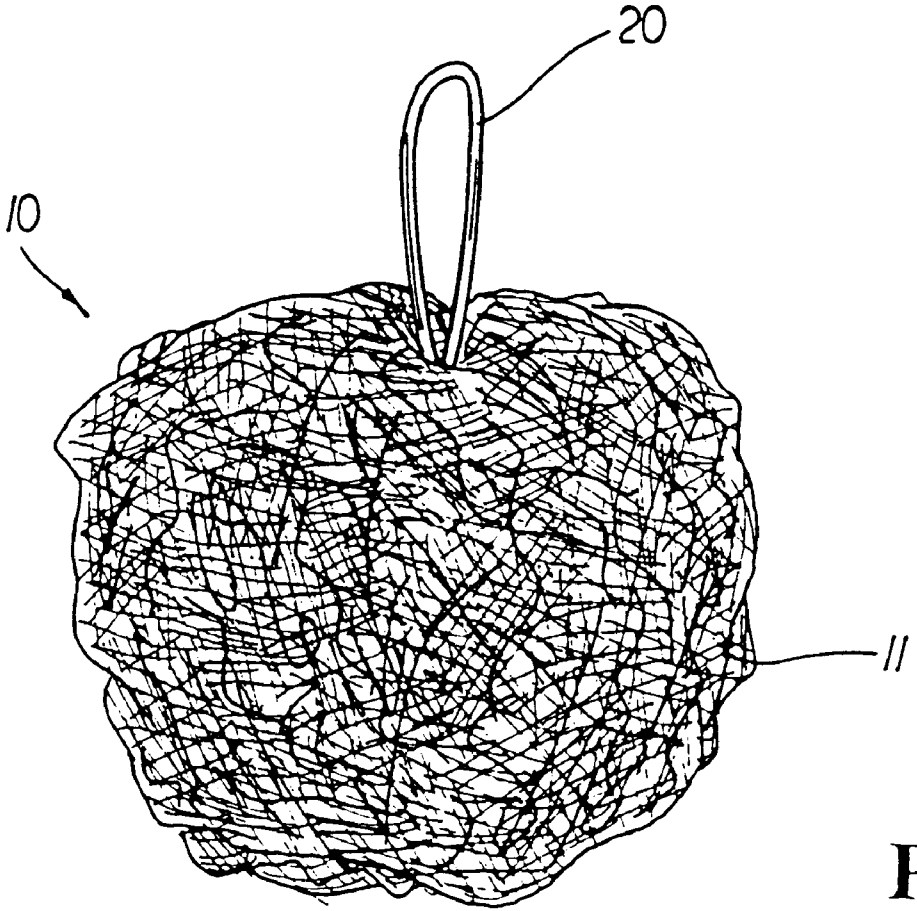
FIG. 1 PRIOR ART
FIG. 1 is a perspective view of a conventional bath ball.
Figure 2:
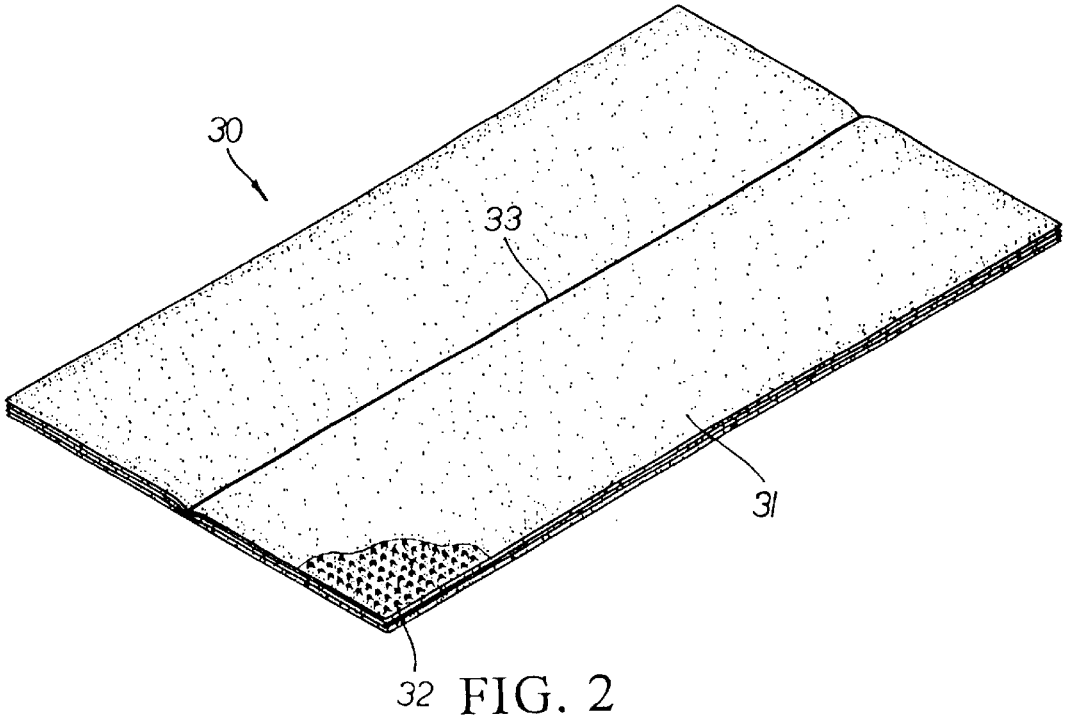
FIG. 2 is a perspective view of the bath ball structure of the present invention.
Figure 3:
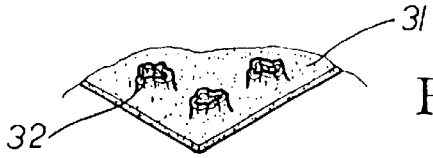
FIG. 3 is an enlarged view of a part of the brushing layer of the bath ball structure of the present invention.

Please refer to FIG. 2. The bath ball structure of the present invention includes a bathing body 30 with a certain dimension and width and a string 50 (also referring to FIG. 4). The bathing body 30 is composed of multiple brushing layers 31 made of plastic membranes and thermally fused with each other. One face of each brushing layer 31 is formed with a number of through holes at equal intervals. The other face of the brushing layer 31 are correspondingly formed with a number of abrasive projections 32 with good frictional force (with reference to FIG. 3). The center of the brushing layers 31 is formed with a thermal fusion seam 33.

Figure 4:
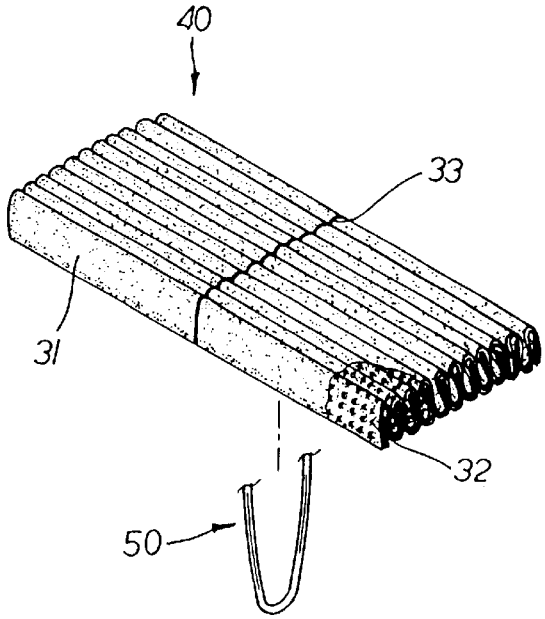
FIG. 4 is a perspective view of the semiproduct of the bath ball structure of the present invention.
Figure 5:
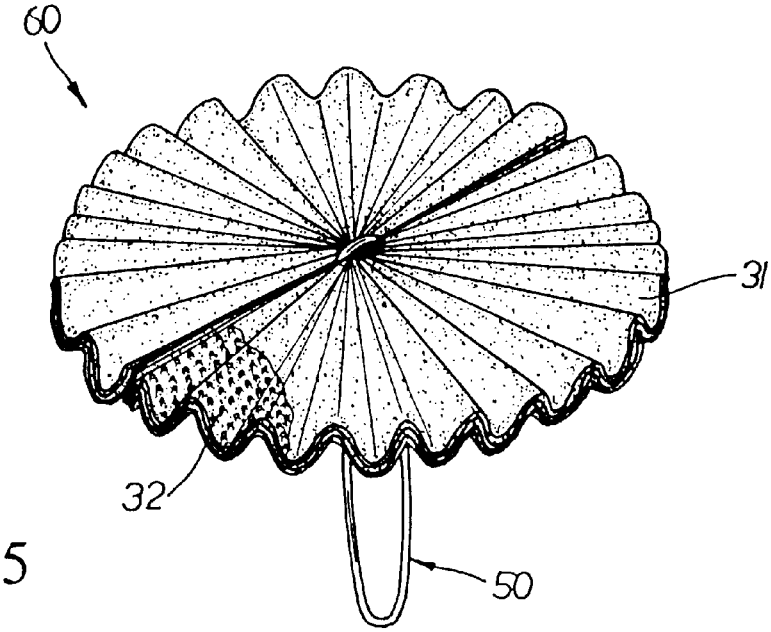
FIG. 5 is a perspective view of the product of the bath ball structure of the present invention.

When assembled, as shown in FIGS. 4 and 5, the bathing body 30 is repeatedly folded back and forth to form a semiproduct 40 of the bath ball having multiple crimps. At this time, the string 50 is tied at the thermal fusion seam 33 of the center of the semiproduct 40 to facilitate taking the semiproduct 40 when used and hanging the semiproduct 40 when not used. The string 50 is tied at the thermal fusion seam 33 of the center of the semiproduct 40 so that after tied, due to the softness and resilience of the folded semiproduct 40 itself, the semiproduct 40 will naturally resiliently stretch outward to form a circular waved bath ball product 60.

Figure 6:
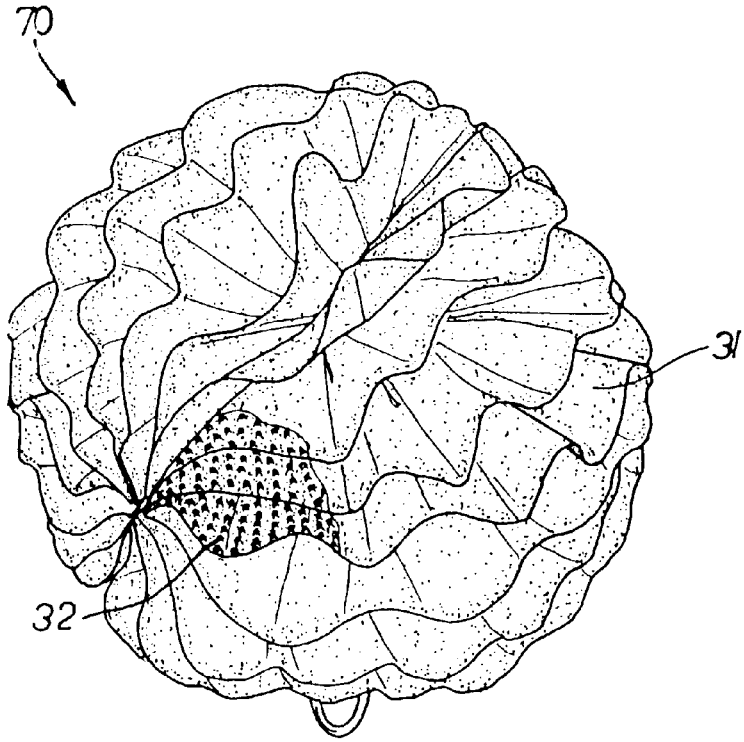
FIG. 6 is a perspective view of the product of the bath ball structure of the present invention in which the brushing layers are pulled outward to form the bath ball.

After assembled, the bath ball product 60 is directly sold to reduce volume and transferring space. When a user desires to use the bath ball product 60, the respective brushing layers 31 of the bath ball product 60 are pulled outward to form a substantially spherical bath ball 70 as shown in FIG. 6. Alternatively, prior to selling, the respective brushing layers 31 of the bath ball product 60 are pulled outward to form a substantially spherical bath ball 70 having solid and beautiful appearance. This can expedite the purchase desire of consumers.

The bath ball of the present invention has the following advantages:

1. The brushing layers 31 are made of plastic membrane which are very soft so that when a user brushes his/her body with the bath ball 70, the user will not feel uncomfortable or painful and the skin of the user is not subject to scrape.
2. A number of abrasive projections 32 are formed over the bath ball 70 so that the bath ball 70 is soft, while providing sufficient frictional force against the skin of the user so that the body of the user can be truly cleaned.
3. Prior to being outward pulled, the bath ball product 60 has small volume so that when transferred or stored, it will not occupy much room so that the transferring and storage are facilitated.
4. The bath ball 70 has a beautiful appearance so that the purchase desire of consumers can be expedited.

The above embodiment is only used to illustrate the present invention, not intended to limit the scope thereof. Many modifications of the above embodiment can be made without departing from the spirit of the present invention.

What is claimed is:

1. A bath ball structure comprising a bathing body and a tying string, the bathing body including multiple brushing layers made of plastic membranes and overlapping one another, the brushing layers being thermally fused with one another at a thermal fusion seam along centers thereof, each brushing layer being formed with a plurality of through holes, such that one face of the brushing layers has a plurality of abrasive projections, the bathing body being formed by repeatedly folding the multiple brushing layers back and forth to form the bathing body having multiple crimps, wherein the tying string is tied at the thermal fusion seam of the bathing body, the multiple brushing layers being pulled outwardly to form the bath ball structure.

* * * * *